United States Patent [19]

Meyer

[11] Patent Number: 4,875,328

[45] Date of Patent: Oct. 24, 1989

[54] PACKAGING MACHINE FOR MULTI-SHEET COMPRESSIBLE PAPER PRODUCTS, SUCH AS PAPER TOWELS, TOLIET PAPER ROLLS AND THE LIKE

[75] Inventor: Dieter Meyer, Ludwigshafen, Fed. Rep. of Germany

[73] Assignee: Paper Converting Machine GmbH, Schifferstadt, Fed. Rep. of Germany

[21] Appl. No.: 191,038

[22] Filed: May 6, 1988

[30] Foreign Application Priority Data

May 14, 1987 [DE] Fed. Rep. of Germany ..... 3716147

[51] Int. Cl.[4] ..... B65B 1/24; B65B 13/20; B65B 39/06; B65B 63/02

[52] U.S. Cl. ..... 53/529; 53/247; 53/258; 100/291

[58] Field of Search ..... 53/258, 438, 439, 528, 53/529, 530, 247; 100/281, 289, 290, 291

[56] References Cited

U.S. PATENT DOCUMENTS

| | | | |
|---|---|---|---|
| 3,006,119 | 10/1961 | Fingerhut | 53/438 |
| 3,354,600 | 11/1967 | Hoffmann | 53/438 |
| 3,507,089 | 4/1970 | Mizelle et al. | 53/131 |
| 3,645,060 | 2/1972 | Hammond | 53/529 X |
| 3,766,706 | 10/1973 | Graham | 53/529 |
| 3,932,981 | 1/1976 | Fillimann et al. | 53/529 |
| 4,679,379 | 7/1987 | Cassoli | 53/438 |
| 4,738,078 | 4/1988 | Benz et al. | 53/528 X |

*Primary Examiner*—John Sipos
*Assistant Examiner*—Beth Bianca
*Attorney, Agent, or Firm*—Frishauf, Holtz, Goodman & Woodward

[57] ABSTRACT

The side walls (6, 7) adjacent a vertically reciprocable platform (3) are moved towards each other to compress compressible products (1), such as kitchen paper towels, toliet paper and the like, for introducing them into a plastic bab (B) upon vertical movement of the platform (3). The side walls are coupled through cam follower rollers (**6*b*, 7*b*) to inclined guide tracks on guide track elements (9, 10), and slidably coupled to move with the platform on a guide rod (8**). The angle of inclination of the guide tracks is adjustable, as well as the separation of the guide tracks from each other, so that the degree of compression, as well as the size of the compressed package, can be readily controlled.

20 Claims, 2 Drawing Sheets

PACKAGING MACHINE FOR MULTI-SHEET COMPRESSIBLE PAPER PRODUCTS, SUCH AS PAPER TOWELS, TOLIET PAPER ROLLS AND THE LIKE

BACKGROUND

It is frequently desired to form large package units for bulk-packaging of compressible paper products, the large package units or assemblies of individual paper packages then being packed in plastic foil bags, either for sale in large lots or on a "wholesale basis" or for shipment and storage. Typical paper packages are disposable paper kitchen towels, usually in roll form, toilet paper rolls, and other similar products for hygienic or cleaning use. The respective product packages—for example a roll of kitchen towel paper—are combined with others in groups which, then, together form the package group or assembly which is to be package in the foil bag. It is desirable to have a predetermined format for the filled bag, such that, when the bag is full, it can be easily fitted on pallets for transport and storage. The foil bags can be pre-manufactured or can be directly made on or by the packaging machine from one or two foil webs. The bags so made can be easily matched to the size of the paper packages when assembled in groups, and placed in the bags.

THE INVENTION

It is an object to improve packaging apparatus for compressible products, and particularly for paper towels, kitchen towel rolls, toilet paper and the like, so that the resulting package, in a foil bag, will have accurately defined dimensions, the foils are compactly packed, and the articles are tightly fitted in the foil bags.

Briefly, the packaging machine has a movable platform and side panels or wall elements are provided which move inwardly towards a central region of the movable platform as the platform is raised.

A simple mechanism can be provided to move side panels inwardly, with respect to the platform, thereby compressing the articles of the group to be introduced into a bag into a tight, accurately dimensioned package assembly. By laterally compressing the packages during raising movement of the platform, no additional time for forming the requisite dimension of the package or assembly is required, while high precision can be insured. Thus, a compact tight fit of the packages, assembled together in groups, within the foil bag will result. The cycling time of the machine is not extended since the side walls move inwardly to compress the packages and define a predetermined dimension of the groups of packages during the raising movement of the packaging platform. The operating speed of the packaging machine is not extended although an additional feature and step is combined with prior packaging, lateral compression of the packages assembled in groups due to the simultaneous movement of the side walls, or at least one of them, towards a central region of the packaging platform.

Various arrangements can be used to move the side walls transversely with respect to the packaging platform. For example, the side walls may be displaced laterally by cylinder-piston units, operated hydraulically or pneumatically. This, however, requires a control system to match the displacement path to the movement of the platform, which usually introduces dead time with respect to the movement of one of the elements. The timing control may be electrical. In accordance with a feature of the invention, and in a preferred form, the side walls are controlled to move inwardly with respect to the table by deriving the lateral movement from the vertical reciprocating stroke movement of the table itself. A mechanical coupling, for example by a crank, an eccenter or the like, may be used.

In accordance with a particularly preferred feature of the invention, the side walls are moved laterally by inclined guide tracks which are coupled to the side walls and further coupled to the vertically reciprocating platform so that, upon movement of the platform, the inclined tracks move the side walls laterally towards each other. The position of the side walls relative to the goods is adjustable with respect to their spacing and/or inclination. The side walls may, for example, be coupled to positioning elements which travel in a stationary inclined guide track, the side walls moving vertically with movement of the platform. Upon vertical movement of the platform, the side walls will, automatically, be shifted laterally due to the inclination of the guide tracks.

DRAWINGS

Illustrating an exemplary embodiment:

FIG. 1 is a highly schematic side view of the apparatus in accordance with the invention; and FIG. 2 is a schematic sectional view, transverse to the illustration of FIG. 1, omitting parts not necessary for an understanding of the invention and illustrating other elements in schematic representation.

DETAILED DESCRIPTION

Figure 1:
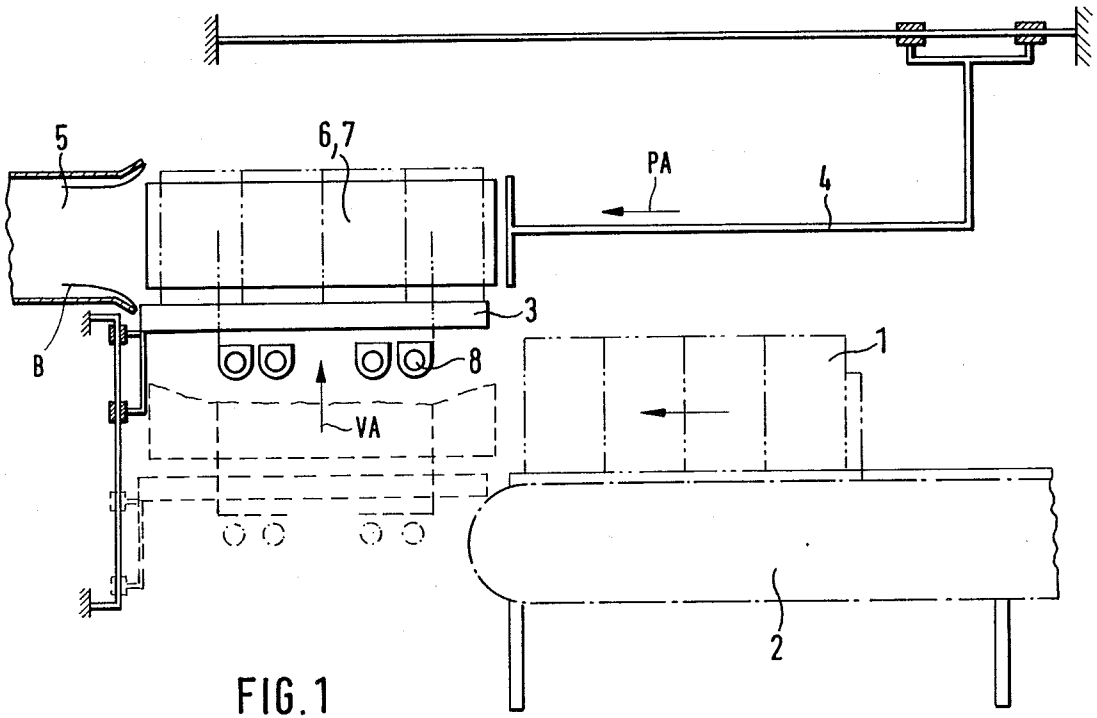

Packages 1, for example kitchen paper towel rolls, already prepackaged in pairs, are supplied on a transport belt 2 in vertical alignment. The transport belt 2 delivers the packages 1 on a vertically reciprocating platform 3, when the platform 3 is in a lower position, shown in broken lines in FIG. 1. When the platform has the requisite and predetermined number of packages 1 located thereon, it is raised vertically upwardly, as shown schematically by the arrow VA in FIG. 1. The platform 3 thus moves the group or assembly of packages 1 in the region of a push rod 4. The push rod 4, operating in the direction of the arrow PA pushes the groups of packages 1 into a bag schematically shown at B, and located at a channel 5. The bag need not be complete when placed behind the channel; foils my be supplied to a bag former, to be seamed as the bag is formed, and the end portion of the bag, likewise, may be seamed, as well known in connection with packaging machinery. The sequence of movement of the packages 1 on the transport belt 2, movement of the platform 3 and of the push rod 4 are well known and can be controlled in any suitable manner.

Two laterally movable side walls 6, 7 are provided, located on either side of the platform 3 and extending through suitable slots or openings within the platform. The platform may be made in form of a grid, for example, through which comblike sidewalls 6, 7 extend. The side walls 6, 7—see FIG. 2—are guided for movement in compressive directions, as schematically shown by arrows VC, and separating directions as schematically shown by arrows VS, on a guide rod 8.

The side walls 6, 7 have downwardly extending projections 6*a*, 7*a* attached thereto which carry rollers 6*b*, 7*b* at the ends thereof. The rollers operate in cam tracks, formed by slits in inclined guide elements 9, 10, respectively. The guide elements 9, 10 are inclined towards each other in an upward direction. Upon vertical movement of the platform 3, then, the side walls 6, 7 necessarily are moved centrally towards each other, thereby compressing packages 1 on the platform 3, as schematically shown by the arrows VC. As the platform 3 moves upwardly, the side walls move towards each other since coupling elements 38 pull walls 6, 7 and rollers **6*b*, 7*b* in the slits of elements 9, 10. Thus, the groups of packages 1 on the platform are automatically compressed as the platform 3** moves vertically.

Figure 2:
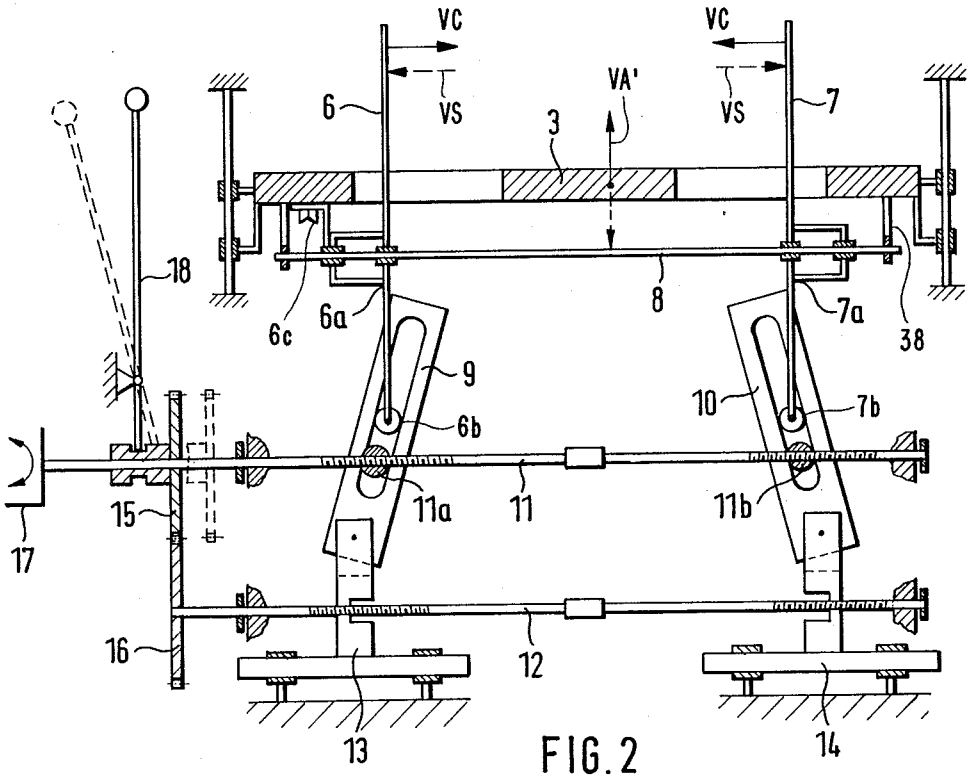

The platform 3 reciprocates in the vertical direction as shown by the double arrow VA' in FIG. 2. Upon downward movement of the platform 3, the side walls 6, 7 spread apart, in the direction of the arrows VS, so that the uncompressed articles 1 can be easily placed by the transport belt 2 on the then lowered platform 3—see FIG. 1.

In accordance with a feature of the invention, the guide elements 9, 10 are adjustably located on a frame of the machine. The frame of the machine has been omitted from the drawings for clarity and may be in accordance with any suitable construction. An upper spindle 11 and a lower spindle 12 are, each, provided. The upper spindle 11 has threaded bolts **11*a*, 11*b* coupled thereto which are fitted in the respective slits of the guide elements 9, 10. The lower spindle 12 is in engagement with horizontally movable or slidable support elements 13, 14 to which the guide elements 9, 10**, respectively, are pivotably connected.

The spindles 11, 12 have threads thereon of respectively opposite pitch so that, upon rotation of the spindles, the bolts **11*a*, 11*b* and the support elements 13, 14 will move towards or away from each other. Thus, the working range of the side walls 6, 7 can be matched to the size of the eventual package to be obtained. The angle of inclination of the slits in the guide elements 9, 10 can be easily maintained at a fixed level by coupling the spindles 11, 12 together by means of meshing gears 15, 16. To adjust the width of the package, it is then only necessary to introduce rotation to one of the spindles, for example by a hand wheel 17 coupled to the end of the spindle 11**.

If the inclination of the guide tracks 9, 10 is to be shifted, that is, the distance of movement of the side walls 6, 7 is to be changed, the gears 15, 16 can be placed out of engagement by laterally shifting gear 15 from the solid-line position to the broken-line position by a handle 18. Thereupon, by rotation of hand wheel 17, the angle of inclination of the guide elements 9, 10 can be independently changed.

Control and initiation of reciprocating movement for the platform 3 is well known and any mechanism in connection therewith has been omitted from the drawings for clarity. Any suitable lifting mechanism, such as a piston-cylinder arrangement or the like may be used.

It is, of course, also possible to adjust only one of the side walls and not the other. Only one of the guide elements 9, 10 is then needed. The opposite side wall can be fixed in place. This, however, has a disadvantage since then the group or assembly of packages 1 will be shifted laterally so that its center line or plane of symmetry will no longer coincide with the center or symmetrical line of platform 3. The embodiment illustrated and described is preferred since symmetry with respect to the receiving former 5 is always ensured. If maintenance or other work is to be done, however, it is only necessary for example to remove the roller **6*b* from the projection or extension 6*a* and secure the side wall 6 in position by a bracket shown schematically at 6*a*. Side wall 6 is then uncoupled from the guide element 9 and compression is applied only by the side wall 7, with side wall 6** acting as a counter element.

The arrangment, and especially in accordance with a preferred form with symmetrical movement of the side walls, has the advantage that a compact tight packaging of groups of compressible packages is possible, with high precision of the final package to be obtained, without in any way interfering with the rapid operating time of apparatus having vertically reciprocating platforms. The side walls move together with rise of the platform and no additional or expensive control apparatus is required.

The extent of compression is readily changed by changing the inclination of the guide elements 9, 10, for example by uncoupling the gears 15, 16 and rotating the spindle 11 by the hand wheel 17. Any new compression then set can be maintained, even with different dimensions of packages, by recoupling the gears and suitably adjusting the spindles 11, 12, conjointly, thereby matching the width of the final packages to be obtained to a desired dimension.

The spindles engage the guide elements 9, 10 at different levels. They permit parallel movement of the side walls and, by selectively coupling or uncoupling, individual movements as well. The gear coupling of gears 15, 16 permits rapid change of the operating or working width of the side walls 6, 7. Thus, versatility and quick adjustment is ensured, and the guide elements 9, 10 automatically move the side walls with the vertical reciprocating movement of the platform 3, under respectively adjusted and re-adjusted positions. Change of compression can be easily obtained by disengaging the gears 15, 16 by the lever and, for subsequent conjoint adjustment, re-engaging the gears.

Various changes and modifications may be made within the scope of the inventive concept.

I claim:

1. Packaging machine for packaging a plurality of compressible products (1) such as multisheet paper products, for example kitchen towel rolls, toilet paper, in a foil bag (B) having an essentially vertically reciprocable platform movable between a lower and an upper position;

transport means (2) loading a group of products on the platform when the platform is at the lower position;

insertion means (4) inserting the products into the bag (B) when the platform is in an upper position by pushing the products into the bag, comprising means for laterally compressing the products prior to being introduced into the bag including laterally movable side walls (6, 7)located adjacent the reciprocable platform (3);

means (**6*a*, 7*a*,*a* 6*b*, 7*b*, 9, 10) for moving said side walls towards said products on the platform during raising movement of the platform from the lower to the upper position, thereby laterally compressing the compressible products on the platform simultaneously with raising of said products located on the platform; and means (9, 10, 38; 11, 12**) coupled to the side walls for adjusting the position of the side walls with respect to said products during said raising movement and to determine the final position of the side walls with respect to the products at the end of the raising movement with respect to at least one of: spacing of said side walls; angle of inclination of the side walls.

2. The machine of claim 1, wherein said means for moving the side walls are operatively coupled to the platform for conjointly effecting movement of the side walls upon reciprocating movement of the platform.

3. The machine of claim 1, wherein the means for laterally moving said side walls (6, 7) comprises at least one inclined guide element (9, 10) defining an inclined guide track, and means (38) for coupling at least one of the side walls to said at least one inclined guide track.

4. The machine of claim 3, wherein the adjustable positioning means (11, 12) comprises means for adjustably controlling the angle of inclination of said guide elements (9, 10).

5. The machine of claim 3, wherein said guide elements, during movement of the reciprocating platform (3), are essentially stationary.

6. The machine of claim 3, wherein the adjustable positioning means comprises means (**11, 12; 11*a*, 11*b*, 13, 14**) for laterally adjusting said guide elements to adjust the spacing thereof.

7. The machine of claim 6, wherein said lateral adjustment means comprises two spindles (11, 12) and threaded spindle engagement elements (**11*a*, 11*b*; 13, 14) coupled to the spindles, the spindle engagement elements being coupled to said guide track means (9, 10**) at respectively different levels of vertical elevation.

8. The machine of claim 7, further including coupling means (15, 16) releasably coupling said spindles for, selectively, coupled conjoint movement or individual movement.

9. The machine of claim 1, wherein the side walls (6, 7) are commonly and essentially symmetrically movable towards each other.

10. The machine of claim 3, wherein said means for adjusting the position of the side walls comprises two spindles (11, 12) and engagement means (**6*b*, 7*b*, 13, 14) respectively coupled to the spindles and to said guide means (6, 7) to change the separation of said guide means (9, 10) and hence of said side walls(6, 7**) without changing the angle of inclination of said guide means.

11. The machine of claim 1, wherein said means coupled tothe side walls for adjusting the position of said side walls comprises externally accessible operating means (17, 18) for effecting said adjustment.

12. Packaging machine for packaging a plurality of compressible products (1) such as multi-sheet paper products, for example kitchen towel rolls, toilet paper, in a foil bag (B) having an essentially vertically reciprocable platform (3) movable between a lower and an upper position;

transport means (2) loading a group of products on the platform when the platform is at the lower position;

insertion means (4) inserting the products into the bag (B) when the platform is in an upper position by pushing the products into the bag, comprising means for laterally compressing said products prior to being introduced into the bag including a laterally movable side wall (7) and a counter side wall (6), said side walls being located adjacent said reciprocable platform and facing each other;

means (**7*a*, 10) for moving said laterally movable side wall towards said counter side wall during raising movement of the platform from said lower to said upper position, thereby laterally compressing the products on the platform simultaneously with raising of the products on the platform; and means (9, 10, 38; 11, 12**) coupled to said movable side wall for adjusting the position of said movable side wall with respect to said products during said raising movement and to determine the final position of said movable side wall with respect to the products at the end of the raising movement with respect to at least one of; spacing of the laterally movable side wall from the counter side wall; angle of inclination of the laterally movable side wall.

13. The machine of claim 12, wherein the means for moving said laterally movable side wall (7) comprises at least one inclined guide element (10) defining an inclined guide track, and means (38) for coupling said laterally movable side wall to said at least one inclined guide track.

14. The machine of claim 13, wherein the adjustable positioning means for said laterally movable side wall comprises means (11, 12) for adjustably controlling the angle of inclination of said guide element (10).

15. The machine of claim 14, wherein said guide element, during movement of the reciprocating platform (3), is essentially stationary.

16. The machine of claim 13, wherein the adjustable positioning means for said laterally movable side wall comprises means (**11, 12; 11*a*, 11*b*, 13, 14**) for laterally adjusting said at least one guide element to adjust the spacing with respect to the counter side wall.

17. The machine of claim 16, wherein said adjustment comprises two spindles (11,12) and threaded spindle engagement elements (**11*a*, 11*b*; 13, 14) coupled to the spindles, the spindle engagement elements being coupled to said guide track means (9, 10**) at respectively different levels of vertical elevation.

18. The machine of claim 17, further including coupling means (15, 16) releasably coupling said spindles for, selectively, coupled conjoint movement or individual movement.

19. The machine of claim 13, wherein said means for adjusting the position of said laterally movable side walls comprises two spindles (11, 12) and engagement means (**6*b*, 7*b*, 13, 14) respectively coupled to the spindles and to said guide means (6, 7) to change the separation of said guide means (9, 10**) and hence of said side walls without changing the angle of inclination of said guide means.

20. The machine of claim 12, wherein said means coupled to said laterally movable side walls for adjusting the position of said laterally movable walls comprises externally accessible operating means (17, 18) for effecting said adjustment.

* * * * *